United States Patent [19]

Nishikawa et al.

[11] 4,154,520

[45] May 15, 1979

[54] ELECTROSTATIC LATENT IMAGE DEVELOPING DEVICE

[75] Inventors: Masaji Nishikawa; Yoshiro Suzuki, both of Hachioji, Japan

[73] Assignee: Olympus Optical Co., Ltd., Tokyo, Japan

[21] Appl. No.: 839,122

[22] Filed: Oct. 3, 1977

[30] Foreign Application Priority Data

Oct. 6, 1976 [JP] Japan ..... 51-119273

[51] Int. Cl.[2] ..... G03G 15/00

[52] U.S. Cl. ..... 355/3 DD; 118/658; 427/18

[58] Field of Search ..... 355/3 DD; 427/18; 118/657, 658

[56] References Cited

U.S. PATENT DOCUMENTS

| | | | |
|---|---|---|---|
| 3,332,396 | 7/1967 | Gundlach | 355/3 DD X |
| 3,900,001 | 8/1975 | Fraser et al. | 118/658 |

*Primary Examiner*—R. L. Moses

*Attorney, Agent, or Firm*—Haseltine, Lake & Waters

[57] ABSTRACT

An electrostatic latent image developing device capable of converting an electrostatic latent image to a visible image with the aid of a toner containing magnetic material is disclosed. The device comprises means for making the moving speed of the toner higher than the travelling speed of the electrostatic latent image.

3 Claims, 6 Drawing Figures

ELECTROSTATIC LATENT IMAGE DEVELOPING DEVICE

BACKGROUND OF THE INVENTION

1. Field of the Invention

This invention relates to an electrostatic latent image developing device capable of converting an electrostatic latent image to a visible image with the aid of a toner containing magnetic material.

2. Description of the Prior Art

Various kinds of developing devices have heretofore been proposed to hold and move a toner containing magentic material and cause it to act upon an electrostatic latent image produced on an electrostatic latent image holding member, for example, a record medium, a drum-shaped photosensitive screen etc. so as to convert the electrostatic latent image to a visible image.

Such developing device, however, has the drawbacks that an electrostatic latent image having a relatively low electric potential of the order of lower than 200 V or dot-shaped electrostatic latent image could not be converted to a picture image having a good graduation.

In addition, since the moving speed of the toner is lower than the travelling speed of the electrostatic latent image produced on its holding member, there is a risk of a black picture image being spattered with the toner caused by presence of a heap of toner particles and being eventually subjected to overdevelopment.

SUMMARY OF THE INVENTION

An object of the invention, therefore, is to provide an electrostatic latent image developing device which can efficiently develop a low potential electrostatic latent image or dot-shaped latent image without producing a heap of toners nor overdevelopment.

A feature of the invention is the provision, in an electrostatic latent image developing device comprising a rotatable cylindrical magnet surrounded by a rotatable non-magnetic sleeve and causing a magnetic toner to move along the peripheral surface of the non-magnetic sleeve and an electrostatic latent image holding member opposed to and distant apart from the non-magnetic sleeve and holding an electrostatic latent image produced thereon, the electrostatic latent image being made contact with the magnetic toner and converted to a visible image picture, the improvement comprising means for making the moving speed of the toner higher than the travelling speed of the electrostatic latent image produced on the holding member.

The invention will now be described in greater detail with reference to the accompanying drawings.

DETAILED DESCRIPTION OF THE INVENTION

In the first place, a principle of a developing device which makes use of a magnetic toner as a developing agent will be described with reference to FIG. 1.

Figure 1:
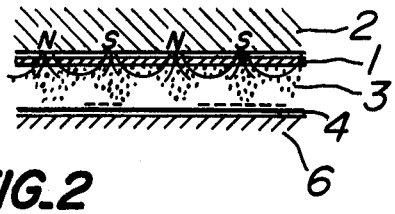
FIG. 1 is a cross-sectional view illustrating a principle of an electrostatic latent image developing device according to the invention.

In FIG. 1, reference numeral 1 designates a non-magnetic member for covering a magnet 2 having magnetic poles N, S, N, S . . . magnetized in its lengthwise direction and equidistant apart from each other. Positioned immediately below the non-magnetic member 1 is an electrostatic latent image holding member 4, for example, a record medium placed on a backing member 6. In a place formed between the non-magnetic member 1 and the record medium 4 is present a magnetic toner 3 fomred of fine particles. The toner particles 3 are arranged along the surface of the non-magnetic member 1 in conformity with magnetic lines of force produced by the magnet 2. The toner particles 3 make contact with an electrostatic latent image produced on the record medium 4 and function to develop the electrostatic latent image to a visible image. In this case, in order to uniformly develop the electrostatic latent image produced on the record medium 4, it is necessary to move the magnetic toner particles 3 or to cause the record medium 4 to be travelled along the backing member 6. In general, the developing device is constructed such that the record medium 4 is mainly caused to be travelled along the backing member 6 and that the magnetic toner particles 3 are supplementarily caused to be moved along the non-magnetic member 1.

Figure 2:
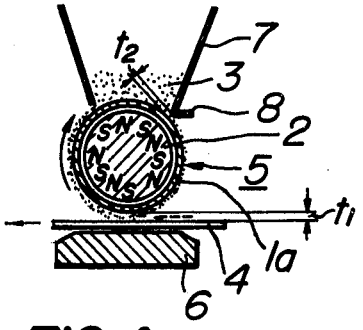
FIG. 2 is a cross-sectional view of one example of an electrostatic latent image developing device for practicing the present invention.

In FIG. 2 is shown a developing device comprising a developing roll 5 composed of a rotatable cylindrical magnet 2 and a rotatable non-magnetic sleeve 1*a* surrounding the magnet 2, a backing member 6 opposed to and distant apart from the developing roll 5 and a hopper 7 arranged immediately above the developing roll 5 and supplying the magnetic toner particles 3 to the outer periphery of the non-magnetic sleeve 1*a*. The device is constructed such that an electrostatic latent image holding member, for example, record medium 4 with an electrostatic latent image produced thereon is caused to be travelled in a direction shown by an arrow and at the same time the non-magnetic sleeve 1*a* is rotated in a clockwise direction shown by an arrow or the magnet 2 is rotated in a counterclockwise direction so as to move the magnetic toner particles 3 in the same direction as the travelling direction of the record medium 4. The hopper 7 is provided at its lower end defining an opening with a doctor blade 8 adapted to adjust a gap $t_2$ formed between the doctor blade 8 and the developing roll 5 so as to adjust the amount of the magnetic toner particles 3 to be delivered from the hopper 7.

In the developing device shown in FIG. 2, a gap $t_1$ between the developing roll 5 and the electrostatic latent image holding member 4 is on the order of 0.4 mm to 0.6 mm and the gap $t_2$ between the doctor blade 8 and the developing roll 5 is on the order of 0.5 mm. If the magnetic 2 is rotated one turn in the counterclockwise direction, the magnetic toner particles 3 on the outer periphery of the non-magnetic sleeve 1a is moved therealong by 1/10 to 1/15 times the outer peripheral length of the non-magnetic sleeve 1a in the clockwise direction shown by the arrow. This moving speed of the magnetic toner particles 3 is on the order of ½ times lower than the travelling speed of the record medium 4. In FIG. 2, the record medium 4 is travelled along a straight line path. In practice, however, a portion of the record medium 4 is travelled along an arcuate path constituting a part of the non-magnetic sleeve 1a.

Inventors' experimental tests made on the developing device shown in FIG. 2 have yielded the result that an electrostatic latent image produced at a relatively high electric potential, usually 400 to 600 V, on a zinc oxide paper used as the record medium 4 can be developed to a good visible image, and that an electrostatic latent image produced on an electrostatic record sheet with the aid of a number of needle electrodes or an electrostatic latent image produced on a record sheet with the aid of a flow of ions control type electrographic apparatus can not be developed to a good visible image due to a low electric potential which is usually lower than 200 V.

Particularly, in the case of flow of ions control type electrographic apparatus, a visible image having a good graduation could not be developed contrary to the inventors' expectations that such visible image having the good graduation might be obtained by means of a magnetic toner capable of converting the electrostatic latent image to an image having a good contrast in the same principle as in the case of the dot printing.

In addition, since the moving speed of the toner is lower than the travelling speed of the record medium 4, the toner 3 on that part of the record medium 4 on which the electrostatic latent image is absent is not completely attracted by the magnetic force of the magnet 2. As a result, the dark picture image located in the rear of the record medium 4 is spattered with the toner thus remained and hence becomes overdeveloped, thereby rendering the development significantly insufficient.

Even when the moving speed of the toner is lower than the travelling speed of the record medium 4, if the electrostatic potential of the electrostatic latent image is relatively high and higher than 200 V, the attractive force of the electrostatic latent image is so strong that a much amount of toner is adhered to the record medium 4 even though a small amount of the toner makes contact with the latent image on the record medium 4, thereby effecting good development.

In accordance with the invention, provision is made of means for making the moving speed of the toner at least 2 times higher than the travelling speed of the record medium 4. If the gap $t_1$ between the developing roll 5 and the backing member 6 is 0.4 mm, it is possible to move the tone 3 at a speed which is 3 to 5 times higher than the travelling speed of the record medium 4. Experimental tests have yielded the surprising result that there is large chance for the toner 3 to be adhered to the electrostatic latent image on the record medium 4 and hence sufficient amount of toner 3 is adhered thereto, thereby efficiently effecting the development without overdevelopment.

It is possible to obtain a good developed picture by widening the gap $t_2$ between the doctor blade 8 and the developing roll 5, and narrowing the gap $t_1$ between the developing roll 5 and the backing member 6.

Figure 3:
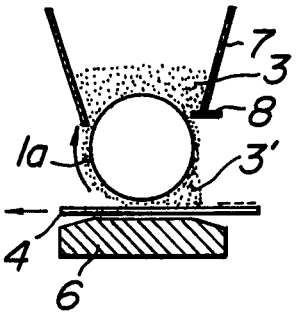
FIG. 3 is a cross-sectional view showing a heap of toner particles collected in the rear of the developing device shown in FIG. 2.

If the moving speed of the toner 3 is made higher than the travelling speed of the electrostatic latent image produced on the record medium 4 and the distance $t_1$ between the developing roll 5 and the backing member 6 is made narrow, the toner particles 3 are collected at that portion of the record medium 4 which is opposed to the non-magnetic sleeve 1a so as to produce a heap of toner particles 3' as shown in FIG. 3. Such toner heap 3' increases a resistance against the travel of the record medium 4, and as a result, the travel of the record medium 4 becomes not uniform. The toner heap 3' is produced owing to the fact that the gap $t_1$ between the developing roll 2 and the backing member 6 becomes narrow when the record medium 4 is inserted therein. The toner heap 3' tends to be gradually eliminated as the record medium 4 passes through the gap $t_1$. But, if a next record medium 4 is inserted into the gap $t_1$ where the toner heap 3' is still remained, the toner 3 is adhered to the back side surface of the record medium 4, causing a stain which tends to spoil the record medium 4.

Figure 4:
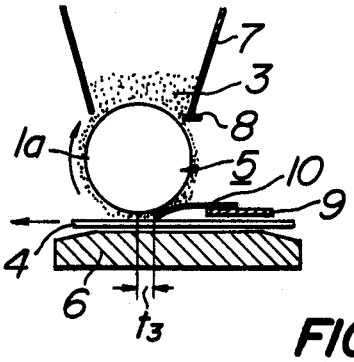
FIG. 4 is a cross-sectional view of a developing device according to the invention which can eliminate the heap of toner particles shown in FIG. 3.

In accordance with the invention, in order to eliminate such drawback, provision is made of a flexible lip-shaped member 10 secured at one end to a supporting member 9 arranged in parallel with and distant apart from the backing member 6 in the rear of a contact portion between the electrostatic latent image produced on the record medium 4 and the magnetic toner 3 as viewed in the travelling direction of the electrostatic latent image as shown in FIG. 4. The free end of the lip-shaped member 10 is bent downwardly and located at the contact portion. The lip-shaped member 10 functions uniformly guide the toner particles 3 along its lengthwise direction toward the contact portion between the electrostatic latent image and the magnetic toner 3 and prevent the toner particles 3 from being deposited thereon, thereby eliminating the toner heap 3'. As a result, it is possible to eliminate the difficult problem of increasing the resistance against the travel of the record medium 4 and producing the stain which has been encountered with the presence of the toner heap 3'.

Figure 5:
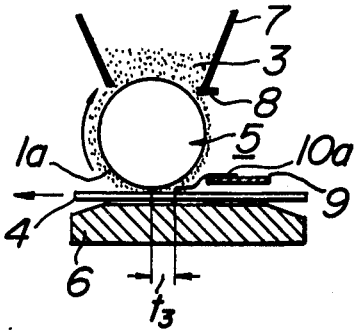
FIG. 5 is a cross-sectional view of a developing device showing a modified type of lip-shaped member shown in FIG. 4.

In FIG. 5 is shown a developing device which makes use of a rigid lip-shaped member 10a instead of the flexible lip-shaped member 10 shown in FIG. 4. The downwardly bent free end of the rigid lip-shaped member 10 is made in parallel with the backing member 6.

In the developing devices shown in FIGS. 4 and 5, if a distance $t_3$ between the lip-shaped member 10, 10a and the perpendicular to the backing member 6 at the point immediately below the center of the developing roll 5 is made substantially zero, the action of the lip-shaped member 10, 10a becomes improved, but the developing action is degraded. The use of the distance $t_3$ of 0 to 10 mm, preferably 4 to 7 mm for a developing roll 5 having a diameter of 30 mm ensures an excellent action of the lip-shaped member 10, 10a without degrading the developing action.

The lip-shaped member 10, 10a must be formed of a non-magnetic material. The flexible lip-shaped member 10 may be formed of a thin tight film without wrinkles such, for example, as a polyethylene telephthalate film having a thickness of 10 to 50μ, various kinds of synthetic resin film, a stainless steel sheet having a thickness of less than 50μ, various kinds of rolled metal films and various kinds of papers, etc. The rigid lip-shaped member 10a may be formed of a slightly thick metal sheet or synthetic resin sheet. The lip-shaped member must be manufactured by taking a gap between it and the developing roll 5 and the flatness thereof into consideration.

In the developing device shown in FIGS. 4 and 5, it is preferable to cause the record medium 4 to travel along a rectilinear path as shown instead of an arcuate path surrounding the developing roll 5.

If the record medium 4 is travelled along the arcuate path, the magnetic toner 3 acts on the record medium 4 over a long distance thereof. As a result, it is difficult to cause the record medium 4 to travel in a steady state when the gap $t_1$ between the developing roll 2 and the record medium 4 is narrow.

Figure 6:
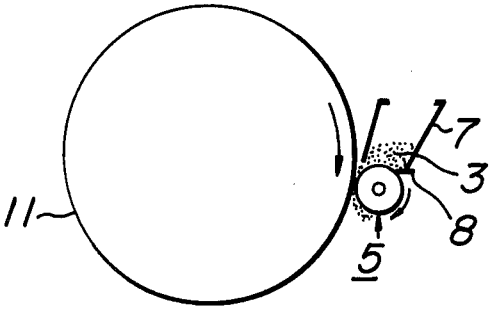
FIG. 6 is a cross-sectional view of a developing device according to the invention constructed so as to develop an electrostatic latent image produced on a photosensitive drum.

In FIG. 6 is shown a developing device according to the invention applied in the case of developing an electrostatic latent image produced on an electrostatic latent image holding member such, for example, as a photosensitive drum 11. In such a case, the toner 3 is moved along the developing roll 5 in a direction shown by an arrow and opposite to the rotating direction of the photosensitive drum 11. As a result, it is possible to make the moving speed of the magnetic toner 3 higher than the peripheral speed of the electrostatic latent image produced on the photosensitive drum 11. In this case, the toner heap 3' eventually produced at that portion of the photosensitive drum 11 which makes contact with the developing roll 5 involves no particular troubles. In addition, the gap $t_1$ between the photosensitive drum 11 and the developing roll 5 can be defined in an extremely stable manner, so that there is no risk of the toner heap being produced. It is preferable to make the moving speed of the toner 2 to 3 times higher than the peripheral speed of the photosensitive drum 11.

As stated hereinbefore, the use of the measures described for making the moving speed of the magnetic toner higher than the travelling speed of the electrostatic latent image ensures an extremely satisfactory development of a dot-shaped latent image produced at a relatively low electric potential such, for example, as an electrostatic latent image produced with the aid of multineedle electrodes and an electrostatic latent image produced on a dielectric coated record sheet by modulating a flow of corona ions by a photosensitive screen.

On the contrary, if the above mentioned electrostatic latent image is developed by a conventional developing device which makes use of a magnetic toner, the developed picture image is relatively decreased in contrast and is insufficient in density. The invention is capable of obtaining a developed picture image having a high density without spoiling the dots, without spattering the toner and without being subjected to overdevelopment. Particularly, the invention is capable of developing an electrostatic latent image produced on a dielectric coated record medium by modulating a flow of corona ions by a photosensitive screen to a beautiful developed image picture which is smooth in halftone and excellent in graduation if compared with that of the latent image produced on the prior art zinc oxide record sheet.

In an electrographic apparatus whose developing speed is high, it is always necessary to move the toner at a speed which is higher than that of any other conventional electrographic apparatus. In th case of moving the toner by rotating a magnet, which has heretofore been frequently used in practice, even when the magnet is rotated at 1,500 r.p.m. relative to a developing roller having a diameter of 30 mm, the moving speed of the toner is nothing but on the order of 200 mm/sec. As a result, the travelling speed of the record medium must be limited to 100 mm/sec. In addition, if the magnet is rotated at the above mentioned high speed, the non-magnetic sleeve made of metal becomes heated thus degrading the fluidity of the toner.

On the other hand, if the non-magnetic sleeve is rotated, the moving speed of the toner becomes substantially equal to the peripheral speed of the non-magnetic sleeve, so that the same moving speed of the toner as that which is obtained by rotating the magnet can be obtained by rotating the non-magnetic sleeve at a rotating speed of about 1/10 lower than the rotating speed of the magnet.

The advantageous effect of the invention will now be described with reference to the following experimental examples.

Experimental Example 1

In the developing device shown in FIG. 2, let the diameter of the non-magnetic sleeve 1*a* be 32 mm, the gap $t_2$ between the doctor blade 8 and the non-magnetic sleeve 1*a* be 0.5 mm and the gap $t_1$ between the record medium 4 and the non-magnetic sleeve 1*a* be 0.5 mm and an electrostatic latent image having a surface electric potential of about 200 V was produced on an electrostatic record medium 4 used as the electrostatic latent image holding member by controlling a flow of ions.

The electrostatic record medium 4 was made travelled at a speed of 100 to 150 mm/sec and at the same time was developed by rotating the magnet 2 at a speed of 300 r.p.m.

The above experimental test has demonstrated the result that the density of the picture image thus developed is not increased, that the picture image feels rough, that much amount of toner is spattered, and that almost all of the dots for constituting the picture image could not be recognized.

Experimental Example 2

In the developing device shown in FIG. 2, let the diameter of the non-magnetic sleeve 1*a* be 32 mm, the gap $t_2$ between the doctor blade 8 and the non-magnetic sleeve 1*a* be 0.6 mm and the gap $t_1$ between the record medium 4 and the non-magnetic sleeve 1*a* be 0.5 mm and an electrostatic latent image having a surface potential of about 200 v was produced on an electrostatic record medium 4 used as the electrostatic latent image holding member by controlling a flow of ions.

The electrostatic record medium 4 was made travelled at a speed of 150 mm/sec and at the same time was developed by rotating the non-magnetic sleeve 1*a* at a speed of 100 r.p.m.

The above experimental test has yielded the result that the picture image feels rough.

Then, the non-magnetic sleeve 1*a* was rotated at higher peripheral speeds of 300 r.p.m., 400 r.p.m. and 500 r.p.m., respectively.

This experimental tests have shown the result that the density of the picture image thus developed is excellent in black, that almost all of the dots for constituting the picture image can clearly be recognized and that the picture image was beautiful without being subjected to overdevelopment.

When the non-magnetic sleeve 1*a* was rotated at a peripheral speed of 200 r.p.m., a picture image whose characteristics are intermediate between those obtained when the non-magnetic sleeve 1*a* was rotated at the peripheral speed of 100 r.p.m. and those obtained when the non-magnetic sleeve 1*a* was rotated at the peripheral speeds 300 r.p.m.

Experimental Example 3

In the developing device shown in FIG. 2, use was made of various combinations of the gap $t_2$ between the doctor blade 8 and the non-magnetic sleeve 1*a* with the number of rotations of the non-magnetic sleeve 1*a* (abbreviated as SR r.p.m. in the following Tables) and experimental tests were carried out in order to ascertain the resolving power, graduation, uniformity of black density, grain property and overall picture quality. In these experimental tests, the gap $t_1$ between the backing member 6 and the non-magnetic sleeve 1*a* was made 0.5 mm and the electrostatic latent image having a surface electric potential of 150 V was produced on the record medium 4 by controlling a flow of ions and was made travelled at a speed of 165 mm/sec.

The experimental test results are shown in the following Tables.

Resolving power

| $t_2$ mm / SR r.p.m. | 0.3 | 0.4 | 0.5 | 0.6 | 0.7 |
|---|---|---|---|---|---|
| 208 | good | very good | good | good | |
| 312 | very good | very good | very good | good | good |
| 416 | very good | very good | very good | very good | good |
| 520 | very good | very good | very good | very good | good |
| 625 | very good | very good | very good | very good | |
| 729 | | very good | very good | very good | |

Graduation

| $t_2$ mm / SR r.p.m. | 0.3 | 0.4 | 0.5 | 0.6 | 0.7 |
|---|---|---|---|---|---|
| 208 | good | good | good | good | |
| 312 | good | very good | very good | good | good |
| 416 | good | very good | very good | good | good |
| 520 | good | very good | very good | very good | good |
| 625 | good | very good | very good | very good | |
| 729 | | very good | very good | very good | |

Uniformity of black density

| $t_2$ mm / SR r.p.m. | 0.3 | 0.4 | 0.5 | 0.6 | 0.7 |
|---|---|---|---|---|---|
| 208 | slightly good | very good | good | good | |
| 312 | slightly good | very good | good | good | good |
| 416 | bad | very good | good | good | good |
| 520 | bad | good | good | lacking in uniformity | good |
| 625 | bad | good | slightly good | lacking in uniformity | |
| 729 | | slightly good | bad | lacking in uniformity | |

Grain property

| $t_2$ mm / SR r.p.m. | 0.3 | 0.4 | 0.5 | 0.6 | 0.7 |
|---|---|---|---|---|---|
| 208 | bad | slightly good | slightly good | slightly good | |
| 312 | bad | very good | good | good | good |
| 416 | good | very good | very good | good | good |
| 520 | good | very good | very good | good | good |
| 625 | slightly good | very good | very good | very good | |
| 729 | | very good | very good | very good | |

Overall picture quality

| $t_2$ mm / SR r.p.m. | 0.3 | 0.4 | 0.5 | 0.6 | 0.7 |
|---|---|---|---|---|---|
| 208 | bad | good Grain property | slightly good | slightly good | |
| 312 | bad | very good | good | good | good |
| 416 | bad | very good | very good | good | good |
| 520 | bad | very good | very good | slightly good | slightly good |
| 625 | bad | good | good | slightly good | |
| 729 | | slightly good | slightly good | slightly good | |

In the above experimental tests, the moving speeds of the toner relative to the travelling speeds of the electrostatic latent image produced on the record medium with respect to the numbers of rotations of the non-magnetic sleeve (SR r.p.m.) were selected as in the following Table.

| Number of rotation of non-magnetic sleeve (SR r.p.m.) | Moving speed of magnetic toner relative to electrostatic latent image |
|---|---|
| 208 | 2.11 Times Higher |
| 312 | 3.16 Times Higher |
| 416 | 4.22 Times Higher |
| 520 | 5.27 Times Higher |
| 625 | 6.22 Times Higher |
| 729 | 7.39 Times Higher |

As seen from the experimental test results listed in the above Tables, the optimum conditions of the gap $t_2$ between the doctor blade 8 and the non-magnetic sleeve 1*a* and the number of rotations of the non-magnetic sleeve 1*a* when the gap $t_1$ between the backing member 6 and the non-magnetic sleeve 1*a* is 0.5 mm are given by:

$t_2$: 0.4 to 0.6 (mm)

SR: 312 to 520 (r.p.m.)

In this case, the moving speed of the magnetic toner is 3 to 5 times higher than the travelling speed of the electrostatic latent image produced on the record medium.

What is claimed is:

1. In an electrostatic latent image developing device comprising a rotatable cylindrical magnet surrounded by a rotatable non-magnetic sleeve and causing a magnetic toner to move along the peripheral surface of said non-magnetic sleeve, an electrostatic latent image holding member opposed to and spaced apart from said non-magnetic sleeve and holding an electrostatic latent image produced threon, said electrostatic latent image contacting said magnetic toner and being converted to a visible image, and means for making the moving speed of said toner at least 2 times higher than the travelling speed of said electrostatic latent image produced on said holding member, the improvement comprising a lip-shaped member secured at one end to a supporting member and arranged in the rear of a contact portion between said electrostatic latent image produced on said holding member and said magnetic toner as viewed in the travelling direction of said electrostatic latent image, the free end of said lip-shaped member being located at said contact portion, said lip-shaped member serving to eliminate any toner build up at said contact portion.

2. The device according to claim 1, wherein said lip-shaped member is formed of a rigid material.

3. The device according to claim 1, wherein said lip-shaped member is formed of a flexible material.

* * * * *